US006591454B2

(12) United States Patent
Brustle

(10) Patent No.: US 6,591,454 B2
(45) Date of Patent: Jul. 15, 2003

(54) HINGE

(75) Inventor: Klaus Brustle, Höchst (AT)

(73) Assignee: Julius Blum Gesellschaft m.b.H., Hochst (AT)

( * ) Notice: Subject to any disclaimer, the term of this patent is extended or adjusted under 35 U.S.C. 154(b) by 0 days.

(21) Appl. No.: 09/964,689

(22) Filed: Sep. 28, 2001

(65) Prior Publication Data

US 2002/0046441 A1 Apr. 25, 2002

(30) Foreign Application Priority Data

Oct. 19, 2000 (AT) ..... 1792/2000

(51) Int. Cl.[7] ..... E05D 11/06
(52) U.S. Cl. ..... 16/374; 16/54
(58) Field of Search ..... 16/374, 375, 376, 16/49, 54, 58, DIG. 9, DIG. 21, 50

(56) References Cited

U.S. PATENT DOCUMENTS

| | | | | | |
|---|---|---|---|---|---|
| 1,700,086 | A | * | 1/1929 | Sherwood | |
| 3,362,042 | A | * | 1/1968 | Salice | 16/278 |
| 3,363,281 | A | * | 1/1968 | Borsani | 16/288 |
| 3,975,791 | A | * | 8/1976 | Hettich et al. | 16/294 |
| 4,023,623 | A | * | 5/1977 | Anderson | |
| 4,075,735 | A | * | 2/1978 | Rock et al. | 16/278 |
| 4,147,261 | A | * | 4/1979 | Dautel et al. | |
| 4,166,307 | A | * | 9/1979 | Rock et al. | 16/288 |
| 4,837,894 | A | * | 6/1989 | Lin | 16/288 |
| 4,872,239 | A | * | 10/1989 | Ferguson et al. | 16/64 |
| 4,948,103 | A | * | 8/1990 | Bowden et al. | 16/84 |
| 5,012,551 | A | * | 5/1991 | Beneke et al. | 16/49 |
| 5,690,194 | A | * | 11/1997 | Parker et al. | 188/82.1 |
| 6,408,483 | B1 | * | 6/2002 | Salice | 16/82 |

FOREIGN PATENT DOCUMENTS

| | | |
|---|---|---|
| DE | 25 39 954 | 1/1977 |
| DE | 298 08 910 | 9/1998 |

* cited by examiner

*Primary Examiner*—Gary Estremsky
*Assistant Examiner*—Mark Williams
(74) *Attorney, Agent, or Firm*—Wenderoth, Lind & Ponack, L.L.P.

(57) ABSTRACT

A hinge for pieces of furniture comprising a hinge arm (2) and a hinge casing (1) which are connected to each other by means of at least one hinge axle. The hinge arm (2) is provided with a fluid damper (20). The fluid damper is mounted on the side of the hinge arm without the use of a tool.

15 Claims, 3 Drawing Sheets

HINGE

BACKGROUND OF THE INVENTION

The invention relates to a hinge comprising a hinge arm hingeably connected to a hinge casing, said hinge casing being tiltable with respect to said hinge arm between and open and a closed position.

It is known to provide pieces of furniture with damping devices to prevent banging of the doors or drawers when they are closed.

The DE 2539954 shows a hinge having an elastically deformable damping element. The damping action of such a damping element is not very significant.

Lately pieces of furniture are provided with fluid dampers. Beside linear dampers in the form of pneumatic or hydraulic dampers, rotary dampers are also in use.

These rotary dampers generally are provided with a housing in which a rotor is mounted. A damping fluid for example silicon oil is provided within the housing. By means of the damping fluid a very good damping effect is achieved when a door or a drawer are moved with too much force.

According to the prior art these damping devices are provided either in the form of a separate damper, on a piece of furniture or they are integral with a hinge.

SUMMARY OF THE INVENTION

It is the object of the invention to provide an improved hinge which can be selectively provided with a fluid damping device. It is a further object of the invention that the damping device can be easily mounted on a hinge ready for use.

According to the invention this object is achieved by providing a fluid damper having a housing and an actuating member moveably mounted in that housing said housing being mounted on a side of said hinge arm said actuating member abutting said hinge casing when the latter is in its closed position.

An embodiment of the invention provides that the hinge arm has U-shaped configuration with a middle web and two side webs said housing being mounted on the middle web.

The housing is preferably held on the hinge arm by means of a protrusion protruding into a hole in the middle web of said hinge arm. The protrusion can be either in the form of a hook or in the form of an elastically deformable peg which is squeezed into the hole in the middle web of the hinge arm.

The actuating member is in the form of a slide linearly moveable within said housing. A piece of furniture according to the invention is provided with a fluid damper having a housing and an actuating member moveably mounted in said housing, said housing being mounted on a side of said hinge arm; said actuating member abutting the door when the door is in its closed position.

BRIEF DESCRIPTION OF THE DRAWINGS

In the following embodiments of the invention will be described in more detail with reference to the companing drawings wherein.

DETAILED DESCRIPTION OF THE INVENTION

Figure 2:
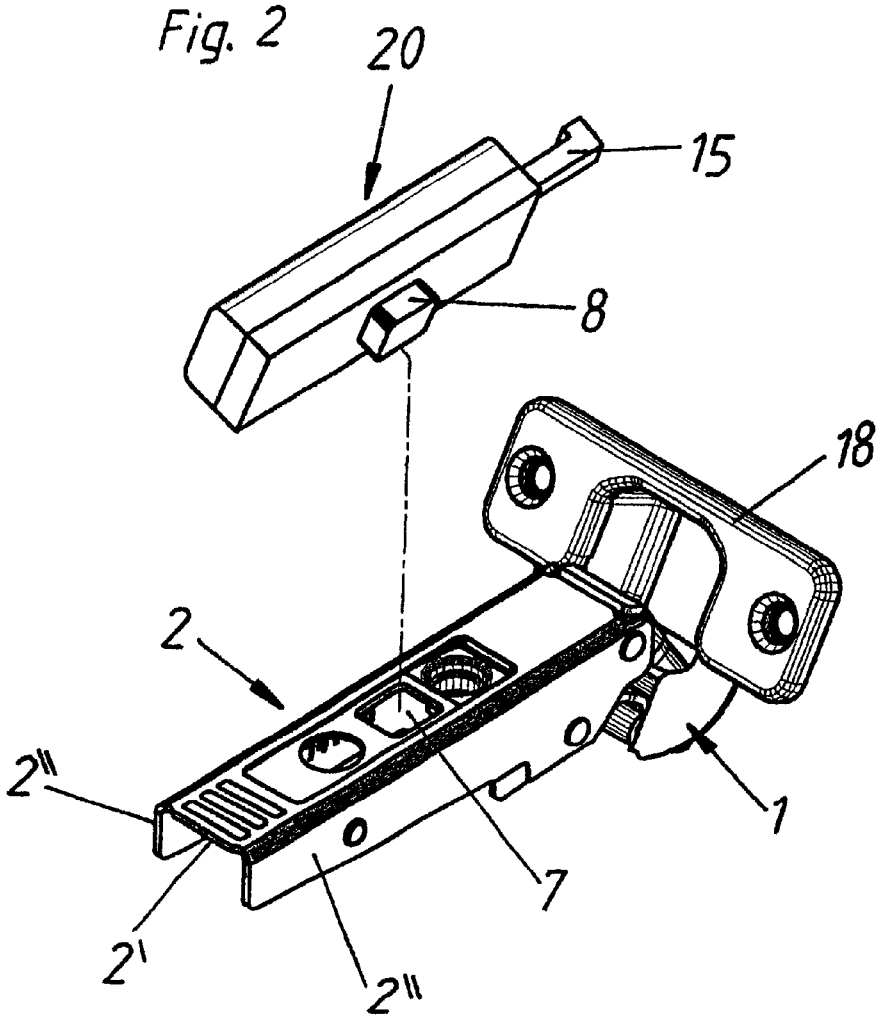
FIG. 2 is a diagrammatically view of a hinge according to the invention and a damper, the two parts being shown apart, FIGS. 3*a* and *b* are side views of a damper.
Figure 1:
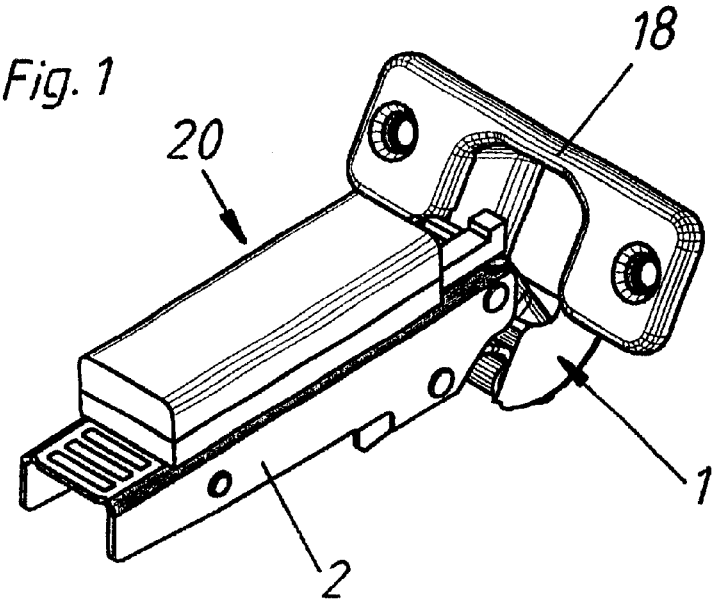
FIG. 1 is a diagrammatically view of a hinge according to the invention.
Figure 5:
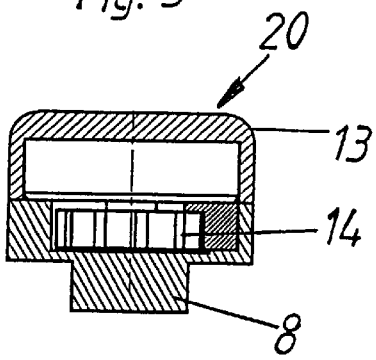
FIG. 5 is a sectional view along line II—II of FIG. 3*a*

A hinge according to the invention is provided with a hinge casing 1 and a hinge arm 2. The hinge casing 1 and the hinge arm 2 are connected by means of an outer hinge link 3 and an inner hinge link 4. The hinge links 3 and 4 are mounted on axles 5, 6 of the hinge arm 2 and the hinge casing 1.

The hinge arm 2 has a U-shaped configuration with a middle web 2' and two side webs 2".

The hinge arm 2 is mounted on an intermediate piece by means of at least one adjustment screw for adjusting the position of the hinge arm in a direction perpendicular to the side wall 11 of the piece of furniture. Advantageously a second adjustment screw or an adjustment disk for adjusting the position of the hinge arm 2 in the direction of the depth of the piece of furniture is provided.

The hinge casing 1 is mounted in a bore in the door 12 of the piece of furniture. The hinge arm 2 together with the intermediate piece is mounted on the base plate 10 which is fastened to a side wall 11 of the piece of furniture.

The middle web 2' of the hinge arm 2 is provided with a hole 7. Because of the hole 7 it is possible to turn the adjustment screw in the intermediate piece or in the mounting plate 10 by means of screw driver.

A hinge of this kind is described in more detail in the U.S. patent specification 60/32,333 of the applicant.

Figure 3A:
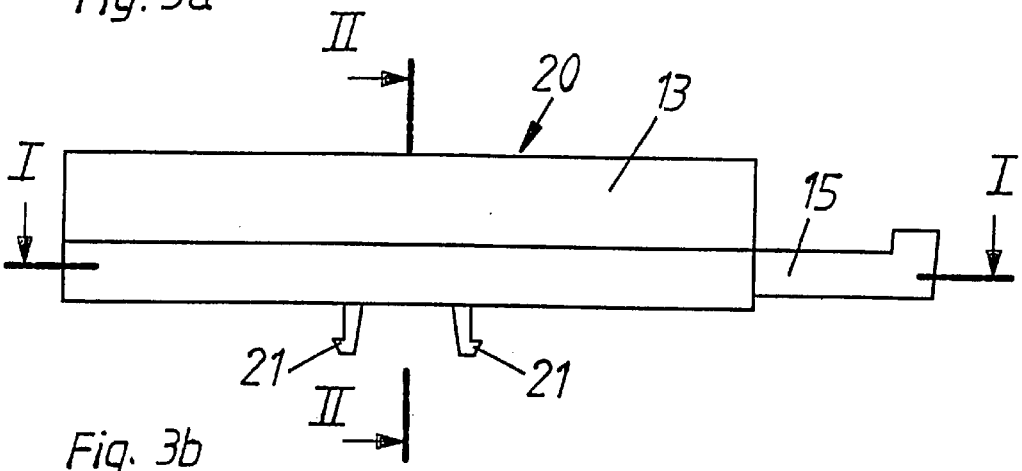

A hinge of this kind can now be provided with a damper 20 according to the invention. The damper 20 has a housing 13 with a mounting projection 8. The damper 20 is mounted on the middle web 2' of the hinge arm 2 whereby the peg like mounting projection 8 is squeezed into the opening 7 of the hinge arm 2. The mounting projection 8 is advantageously elastically deformable so that the mounting projection 8 is clamped in the hole 7 (FIGS. 2, 3*a*).

Figure 3B:
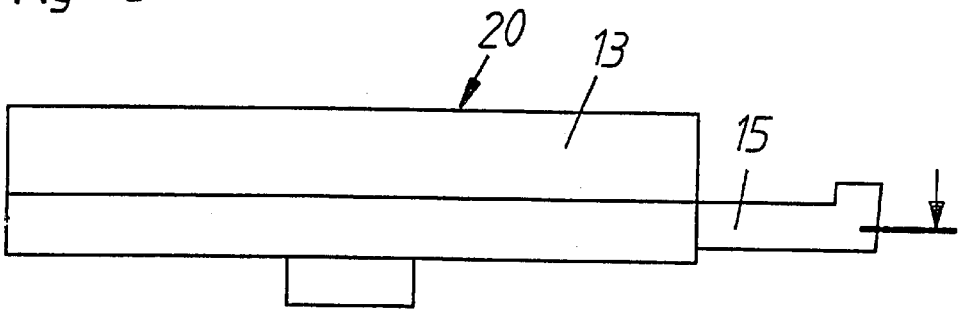
Figure 4:
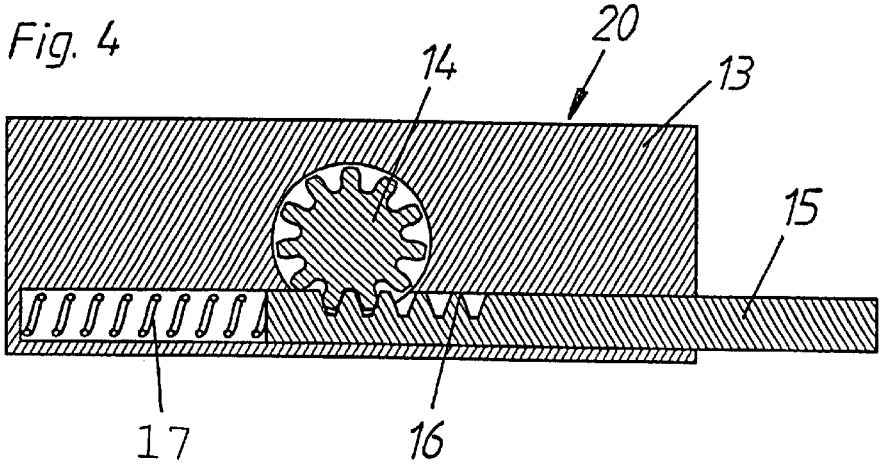
FIG. 4 is a sectional view along line I—I of FIG. 3*a*
Figure 6:
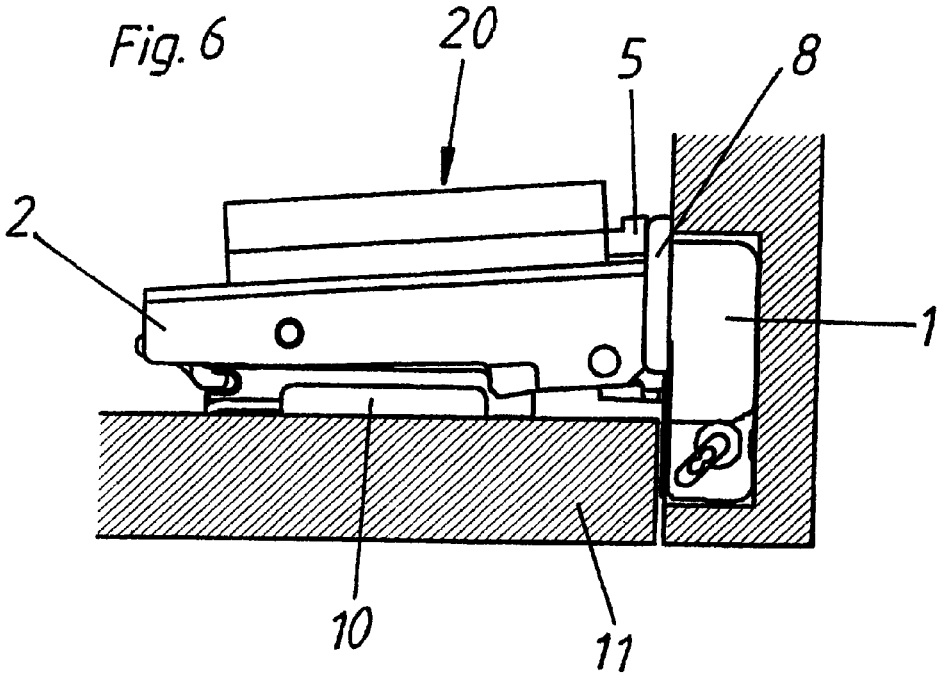
FIG. 6 is a side view of a hinge according to the invention in the closed position and FIG. 7 is a side view of a hinge according to the invention in the opened position.

In the embodiment of FIG. 3*b* the housing 13 is provided with two hooks 21 which protrude into the hole 7 of the hinge arm 2 thereby clamping the housing 13 to the hinge arm 2. In both cases the damper 20 can be mounted on the hinge arm 2 without the use of a tool.

In the embodiment shown the damper 20 in use is a rotary damper with a pinion 14 which is situated within the housing 13. The pinion 14 meshes with a rack 16 on a slide 15. The slide 15 is the actuating member of the damper 20. The slide 15 is linearly moveable within the housing 13 whereby a spring 17 acts on the slide 15 pushing the slide 15 into its stand-by position. When the door 12 is closed the flange 18 of the hinge casing 1 presses on to the slide 15 whereby the slide 15 is pushed into the housing 13. Thereby the pinion 14 is rotated and the closing movement of the door 12 is dampened.

Figure 7:
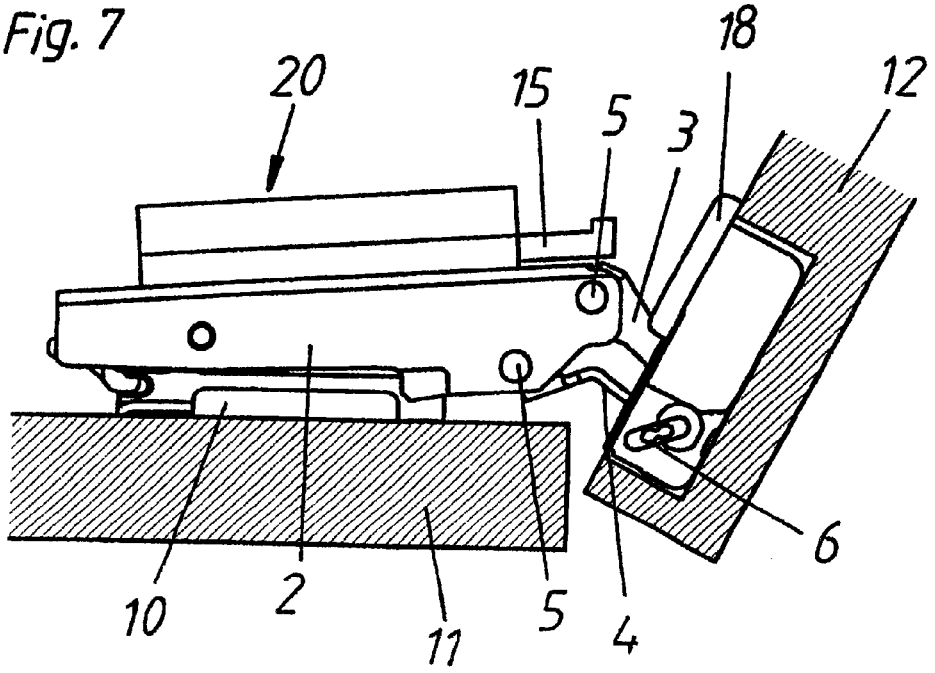

After opening the door 12 the spring 17 again pushes the slide 15 into the stand-by position shown in FIG. 7.

In the embodiment shown the rotary damper is a fluid damper. Instead of a rotary damper other fluid dampers with linearly moveable pistons could be employed. These dampers could be pneumatic dampers as well as hydraulic dampers.

What is claimed is:

1. A hinge comprising:

a hinge casing;

an oblong hinge arm pivotally connected to said hinge casing so that said hinge casing is operable to pivot with respect to said hinge arm between an open position and a closed position; and a fluid damper including a housing and an actuating member arranged in said housing so as to be operable to move relative to said housing, said housing being mounted on said hinge arm such that said actuating member is aligned along a longitudinal axis of said hinge arm and such that an end of said actuating member abuts said hinge casing when said hinge casing is in the closed position.

2. The hinge of claim 1, wherein said hinge arm has a U-shaped cross-sectional configuration including a middle web portion and two side web portions, said housing of said fluid damper being mounted on said middle web portion.

3. The hinge of claim 2, wherein said middle web portion of said hinge arm has a hole, said housing of said fluid damper having a protrusion extending into said hole.

4. The hinge of claim 3, wherein said protrusion comprises a hook.

5. The hinge of claim 3, wherein said protrusion comprises an elastically-deformable peg squeezed into said hole in said middle web portion.

6. The hinge of claim 1, wherein said actuating member comprises a slide operable to slide linearly relative to said housing along the longitudinal axis of said hinge arm.

7. The hinge of claim 6, wherein said hinge casing has a flange portion, an end of said slide being operable to abut said flange when said hinge casing is in the closed position.

8. The hinge of claim 1, wherein said housing of said fluid damper is operable to be fastened to said hinge arm without a tool.

9. The hinge of claim 1, wherein said fluid damper comprises a linear damper.

10. The hinge of claim 9, wherein said linear damper comprises a pneumatic damper.

11. The hinge of claim 9, wherein said linear damper comprises a hydraulic damper.

12. The hinge of claim 1, wherein said fluid damper comprises a rotary damper.

13. The hinge of claim 1, wherein said housing of said fluid damper has a hook-shaped protrusion extending into a hole in said hinge arm so as to attach said housing to said hinge arm.

14. The hinge of claim 1, wherein said housing of said fluid damper has an elastically-deformable peg extending into a hole in said hinge arm so as to attach said housing to said hinge arm.

15. A furniture component comprising:

a side wall;

a door; and a hinge for pivotally connecting said door to said side wall, said hinge including:

a hinge casing mounted on said door;

an oblong hinge arm fastened to said side wall and pivotally connected to said hinge casing so that said door is operable to pivot with respect to said side wall between an open position and a closed position; and a fluid damper including a housing and an actuating member arranged in said housing so as to be operable to move relative to said housing, said housing being mounted on said hinge arm such that said actuating member is aligned along a longitudinal axis of said hinge arm and such that an end of said actuating member abuts said door when said door is in the closed position.

* * * * *